US005158233A

United States Patent [19]

Foster et al.

[11] Patent Number: 5,158,233

[45] Date of Patent: Oct. 27, 1992

[54] FOAMER TRIGGER DISPENSER WITH SEALING DEVICE

[75] Inventors: Donald D. Foster, St. Charles; Philip L. Nelson, St. Peters, both of Mo.

[73] Assignee: Contico International, Inc., St. Louis, Mo.

[21] Appl. No.: 772,700

[22] Filed: Oct. 7, 1991

[51] Int. Cl.[5] ..... B05B 9/043; B05B 7/30

[52] U.S. Cl. ..... 239/333; 239/354; 239/569; 222/380; 222/383

[58] Field of Search ..... 239/288, 302, 333, 349, 239/354, 569; 222/380, 383, 546, 556

[56] References Cited

U.S. PATENT DOCUMENTS

| | | | |
|---|---|---|---|
| 1,791,440 | 2/1931 | Aronson | 239/349 |
| 1,900,087 | 3/1933 | Aronson | 239/349 |
| 3,913,841 | 10/1975 | Tada | 239/349 X |
| 4,153,203 | 5/1979 | Tada . | |
| 4,230,277 | 10/1980 | Tada . | |
| 4,350,298 | 9/1982 | Tada . | |
| 4,463,905 | 8/1984 | Stoesser et al. . | |
| 4,603,812 | 8/1986 | Stoesser et al. . | |
| 4,606,480 | 8/1986 | Gazulla | 222/383 X |
| 4,669,665 | 6/1987 | Shay . | |
| 4,730,775 | 3/1988 | Maas . | |
| 4,767,060 | 8/1988 | Shay et al. . | |
| 4,768,717 | 9/1988 | Shay . | |
| 4,779,803 | 10/1988 | Corsette . | |
| 4,815,663 | 3/1989 | Tada . | |
| 4,883,227 | 11/1989 | Maas . | |
| 4,890,792 | 1/1990 | Martin et al. . | |
| 4,911,361 | 3/1990 | Tada . | |
| 4,953,791 | 9/1990 | Tada . | |
| 4,958,754 | 9/1990 | Dennis | 239/333 X |

*Primary Examiner*—Andres Kashnikow
*Assistant Examiner*—William Grant
*Attorney, Agent, or Firm*—Rogers, Howell & Haferkamp

[57] ABSTRACT

A trigger sprayer having a nozzle assembly with a foam-inducing tube in front of its nozzle outlet orifice, an elongated pin having a convex tip for sealing the orifice, a door supporting the pin, and a hinge connecting the door to the nozzle assembly and strategically located to prevent interference between the pin and the tube when the door is swung about its hinge.

14 Claims, 2 Drawing Sheets

FIG. 1.
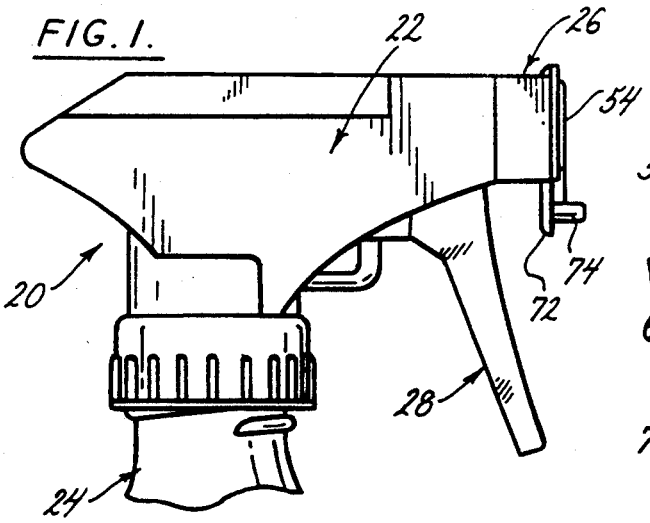
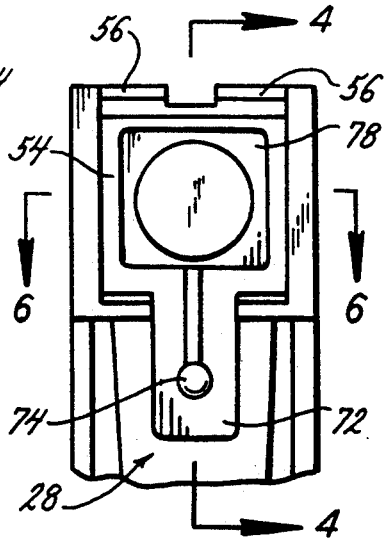
FIG. 2.
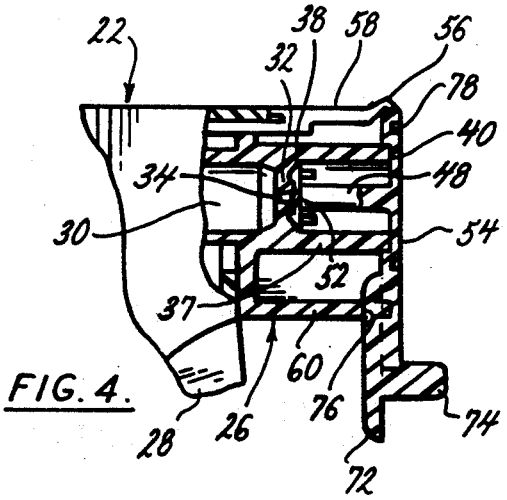
FIG. 4.
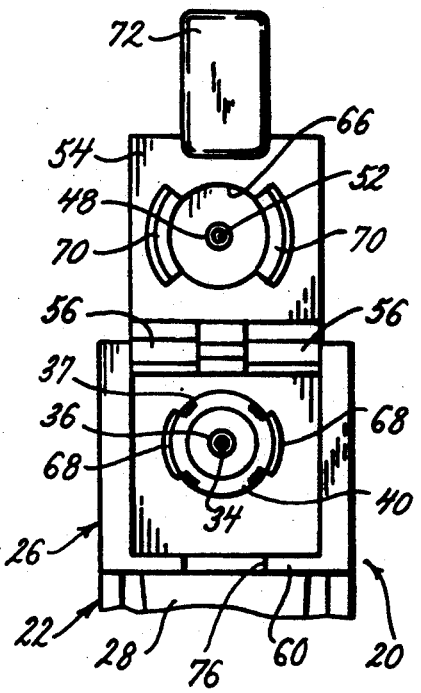
FIG. 3.
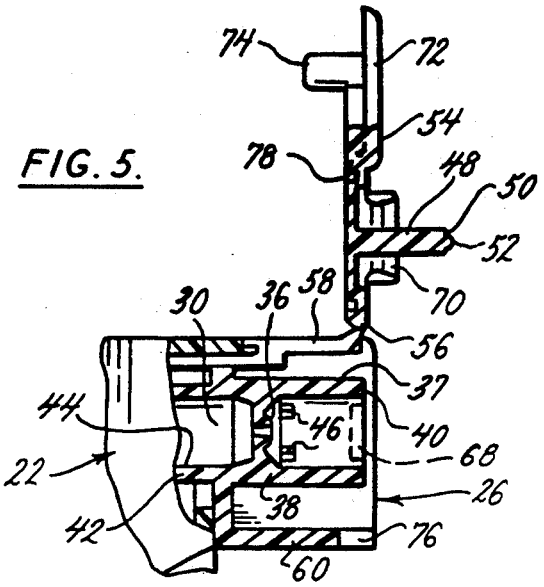
FIG. 5.

FIG. 6.
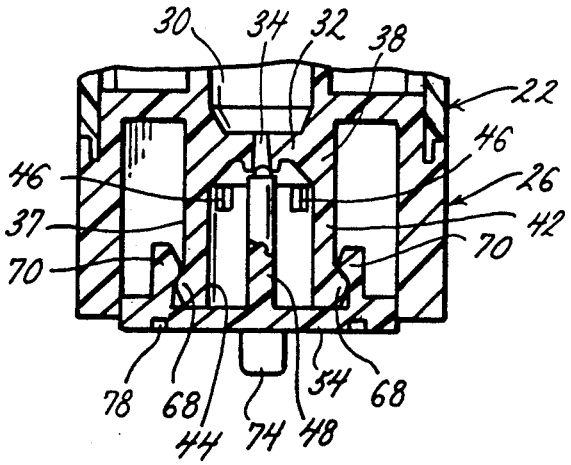
FIG. 7.
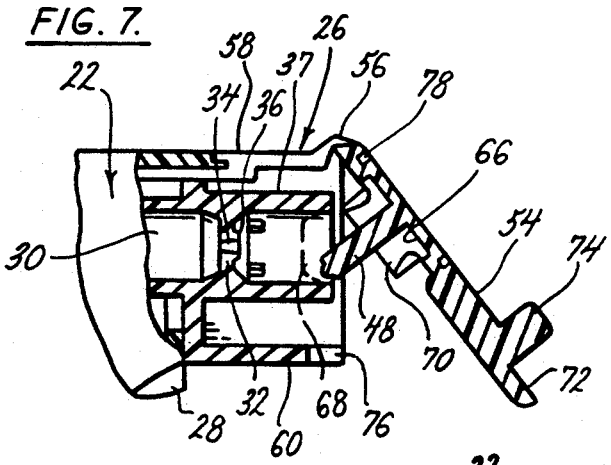
FIG. 9.
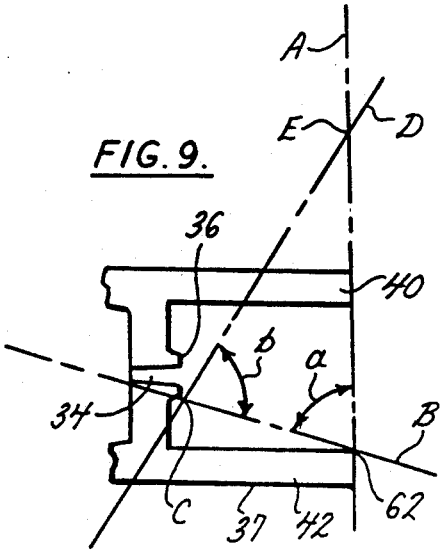
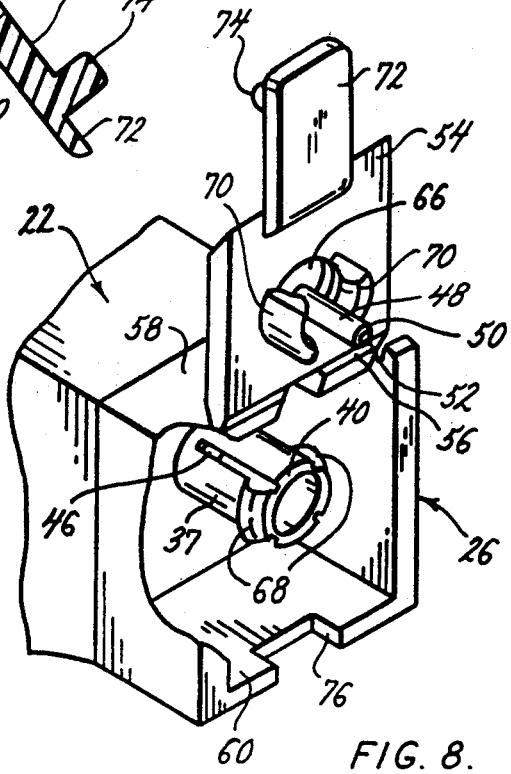
FIG. 8.

FOAMER TRIGGER DISPENSER WITH SEALING DEVICE

BACKGROUND OF THE INVENTION

This invention is directed to the field of trigger dispensers, also known as trigger sprayers. The invention is particularly directed to a trigger sprayer having structure for foaming a dispensed liquid and to the incorporation of a device integral with the sprayer nozzle assembly for sealing the nozzle orifice of a foamer trigger sprayer.

There are numerous patents that have issued on trigger dispensers of the general type to which this invention relates. The patents discussed below exemplify such trigger dispensers. Generally, a trigger dispenser of the type involved here is a relatively low-cost pump device which is held in the hand and which has a trigger operable by squeezing or pulling the fingers of the hand to pump liquid from a container and through a nozzle at the front of the dispenser.

Such trigger dispensers may have a variety of features that have become common and well-known in the industry. For example, the dispenser may be a dedicated sprayer that produces a defined spray pattern for the liquid as it is dispensed from the nozzle. It is also known to provide adjustable spray patterns such that with a single dispenser the user may select any one of several stream patterns from a stream to a fine mist. Some known trigger dispensers also include a way to seal the dispenser to prevent liquid from leaking from the nozzle orifice during shipment or non-use. A variety of sealing arrangements are known as will be more fully explained.

It is also well-known to provide trigger dispensers with a means to produce foaming of the liquid as it is dispensed from the nozzle orifice. Such trigger dispensers are generally referred to in the industry as "foamers". Typically, the foam is produced by providing a structure forward of the nozzle orifice upon which the liquid from the orifice impinges to produce turbulence, and thus foaming of the liquid, and/or the added structure has openings for admitting air for entrapment by the liquid to cause the foaming. Various types of foamers are known as will be more fully described below.

Also, it is well known to provide foamers with a means for sealing the orifice to prevent leakage of the fluid from the dispenser during shipment or non-use. Examples of known foamers with sealing means are described below. As will be more fully described, the present invention is specifically directed to a trigger dispenser of the foamer type and with a simpler and less expensive means for sealing the dispenser from leakage during shipment or non-use.

U.S. Pat. No. 4,350,298 discloses a foamer trigger dispenser of several embodiments. A first embodiment is shown in FIGS. 1 and 2 where a hinged door may be placed in position in front of the nozzle orifice to produce a foam. No means are provided for sealing the orifice.

The embodiment of FIGS. 5–9 has a nozzle cap that produces foaming and where the cap is operable in a sliding or push-pull fashion. The nozzle includes a sealing member or rod which is capable of closing the nozzle orifice. By sliding the nozzle to the extended position, the dispenser operates as a foamer, and by sliding the nozzle to the retracted position the rod seals the orifice and prevents leakage. This embodiment has the advantage of a means for preventing leakage, but has the disadvantage of having a push-pull type nozzle. Nozzles that operate between open and closed positions by either a push-pull operation or a twisting or turning operation have the disadvantage that the user finds it difficult to operate the nozzle. The user may not know how to operate it at all, or may think it should be operated by turning when it should be operated by push-pull, or vice versa. This embodiment also has a disadvantage of being more complex to manufacture.

A third embodiment is shown in FIGS. 10–13. The nozzle cap that produces foaming is screwed to the dispenser body and operates between a sealing position and a foaming position by turning the cap. This embodiment has the disadvantage of requiring a screw cap that must be turned by the user to operate the dispenser between a closed non-leak position, and an open foaming position. As with the previous embodiment, users are often confused as how to operate a dispenser that has either a twist cap or a push-pull cap. Also, the screw cap requires molding a separate part and thereby adds to the expense of the dispenser.

U.S. Pat. Nos. 4,463,905 and 4,603,812 disclose a foamer trigger dispenser with a hinged door having a screen such that pivoting the door to a position in front of the nozzle orifice produces foaming, and pivoting the door so as to remove the screen from in front of a nozzle orifice produces a spray. With the dispenser of these patents the hinged door is for the purpose of selecting either the spray or foaming condition. While the trigger dispensers of these patents do not appear to have a means for sealing the orifice against leakage, it is known in the art to provide such a sprayer with a twist nozzle whereby the nozzle, including the hinged door, is turned between off and on positions. In the off position the liquid is prevented from reaching the orifice while in the on position the liquid is allowed to flow to the orifice. This dispenser, with a nozzle that must be rotated between seal and non-seal positions, has the same disadvantages as noted above.

U.S. Pat. No. 4,669,665 discloses a foamer nozzle which includes a cylinder extending forwardly of the nozzle orifice such that the spray from the orifice impinges on the inner cylindrical wall of the cylinder to produce turbulence, aeration, and foaming of the liquid. No sealing means are disclosed for preventing leakage. However, other trigger sprayers are known in the art that have a nozzle with a foaming cylinder extending forwardly of the nozzle in axial alignment with the nozzle. The foaming cylinder has radially extending holes at its base. The cylinder is of a diameter and length such that the spray from the orifice impinges on the inner cylindrical wall of the cylinder to produce turbulence, and such that air is drawn inwardly through the openings to mix with the turbulent spray within the cylinder to produce foaming, assuming of course that the liquid has a foaming agent. This foamer also has a means for sealing against leakage which includes a twist-type nozzle which is turned between on and off positions. In the on position liquid is allowed to pass through the orifice whereas in the off position the liquid flow to the orifice is blocked. This foamer has the same disadvantages as with the other foamers having twist or screw-type nozzles.

Other prior art patents representative of foamer trigger dispensers having foamer nozzles of the twist cap or screw cap type, or sliding push-pull type, some of which have means for sealing the orifice, are U.S. Pat. Nos. 4,730,775, 4,767,060, 4,768,717, 4,779,803, 4,883,227, 4,890,792, 4,911,361, and 4,953,791. U.S. Pat. No. 4,779,803 combines twist and push-pull operations whereby the nozzle is turned or twisted to operate it between off and spray positions, with a moveable element which slides between a retracted position where it does not influence the spray from the orifice and an extended position spaced forwardly of the nozzle orifice to modulate the spray and produce foaming, if the liquid contains a foaming ingredient. The foamer of this patent has the disadvantages of twist-type nozzle and push-pull operation as heretofore explained.

Other examples of foamer trigger dispensers are shown by Japanese Patents 63-193556, 1-110863, and 2-61456. The dispensers of these patents have an integrally hinged door with an opening in the door and a cylindrical portion surrounding the opening and extending rearwardly therefrom toward the nozzle orifice. When the door is in its closed position, the cylinder also surrounds the nozzle orifice and becomes axially aligned with the orifice such that spray from the orifice impinges on the inner cylindrical wall of the cylinder to produce foaming, the foam exiting through the opening in the hinged door. While Japanese Patent 63-193556 does not show any means for sealing the orifice to prevent leakage, it is known in the prior art to provide a separate plug insert with a cylindrical portion that fits within the door cylinder. At the opposite side of the cylindrical portion is a semi-spherical element. With the cylindrical portion of the plug inserted into the door cylinder, and with the door closed, the semi-spherical element seats within the nozzle orifice to seal the orifice. The separate plug is inserted for shipping to prevent leakage, but must be removed in order to use the dispenser as a foamer.

U.S. Pat. Nos. 4,153,203, 4,230,277, and 4,815,663 and Japanese Patents 3-32758 and 57-32626 disclose trigger dispensers having a nozzle cover or door connected to the nozzle with an integrally formed hinge. The cover may be pivoted between a locked position where it is out of the way of the nozzle orifice so that liquid may be sprayed from the dispenser by operation of the trigger, and a seal position where the cover overlies the nozzle orifice to prevent liquid from leaking from the orifice such as during shipment or non-use. The cover has a central seal section with a semi-spherical portion (76/176) which seats against the nozzle orifice with the cover in the seal position to seal the orifice. While the patent discloses a desirable integrally hinged door pivotable between an operating position and a seal position, and thus overcomes the disadvantages of trigger dispensers utilizing twist or push-pull type nozzles for that purpose, there is no disclosure in the patent of any means for producing foam.

To summarize the prior art, there are foamer trigger dispensers which have pins that seat within the nozzle orifice to seal the orifice against leakage, but with such foamers the orifice and pin are moved relative to each other between sealing and non-sealing positions by either turning the nozzle or sliding the nozzle with a push-pull operation. The turning or sliding action assures that the path of movement of the pin will be restricted to an axial path within a cylinder, thereby assuring that the path of the pin will not intersect any portion of the wall of the cylinder. Thus, such foamers have the disadvantage of being confusing to operate as explained above. Other prior art foamers have hinged doors that may be pivoted between open and closed positions to select either spray or foam, but such foamers either have no means at all to prevent leakage, or if they do have such means they require a separate plug which is relatively expensive and must be removed to use the foamer or require turning the nozzle with the disadvantages heretofore explained. There are also prior art trigger dispensers with hinged doors that may be pivoted between seal and non-seal positions and where the door has a semi-spherical element that seats in the orifice to seal the orifice with the door in the seal position. However, such dispensers are not foamers.

Thus, the prior art suggests that a seal for the nozzle orifice of a nonfoaming trigger sprayer can be on a hinged door, but the door is mounted in general vertical alignment with the orifice. However, on a trigger sprayer having a foam inducing cylinder projecting forward of the nozzle orifice, an elongated pin having an end for sealing the nozzle orifice must be moved axially within the foam inducing cylinder, or the orifice sealer must be on a separate removable element.

The present invention overcomes the disadvantages of the prior art foamers and provides a unique foamer trigger dispenser with means for sealing against leakage such as during shipment or non-use, which is relatively inexpensive to manufacture, and which is exceptionally easy to use.

SUMMARY OF THE INVENTION

In accordance with the foamer trigger dispenser of this invention, the nozzle has an orifice through which liquid is dispensed upon operation of the trigger. A foaming tube, preferably cylindrical, is formed integrally with the nozzle. The tube or cylinder extends forwardly from the nozzle in axial alignment with the nozzle. The length and diameter of the cylinder are selected such that the spray from the orifice impinges on the inner cylindrical wall of the cylinder to produce turbulence. Openings extend through the cylinder wall to draw air into the cylinder which mixes with the spray emitted from the orifice. Assuming that the liquid has a suitable foaming agent, the turbulence created by the spray striking the inner cylindrical wall of the cylinder, and air mixing with the turbulent spray, produce foaming of the liquid which is dispensed from the open end of the cylinder.

Sealing means are provided to seal the foamer against leakage. In accordance with this invention the sealing means comprises a door integrally hinged to the nozzle, preferably at the top thereof. The door is pivotal between a closed position where the door overlies the front of the nozzle, and thereby overlies the open end of the foaming cylinder, and an open position with the door unobstructing the liquid emitted from the nozzle. Suitable latching means are provided for releasably securing the door in its closed position, and the living hinge incorporates a memory that positions the door in its open position when the securing means are removed.

As an important feature of the invention the door includes an elongated pin such that with the door closed the pin is in axial alignment with the orifice. The outer end of the pin has a surface that seats within the orifice in sealing engagement therewith to seal the orifice against leakage when the door is closed. When the door is open, the pin swings away from the orifice out of sealing engagement therewith. The geometry of the foaming cylinder, door pivot axis, and sealing pin position and length are such that the pin clears the foaming cylinder upon opening and closing the door, and is in axial alignment with the orifice and in sealing engagement therewith with the door closed, all of which is accomplished without any degradation in performance in producing foaming.

The nozzle and hinged door assembly is easy to use and inexpensive to manufacture, being integrally formed. No separate plug or turning or reciprocating of the nozzle is required for sealing.

BRIEF DESCRIPTION OF THE DRAWINGS

FIG. 1 is a side elevation view of the trigger sprayer.

FIG. 2 is an enlarged front elevation view of the trigger sprayer with the door in the closed position.

FIG. 3 is a front elevation view of the trigger sprayer with the door in the open position.

FIG. 4 is a view in section of the trigger sprayer taken along the plane of the line 4—4 of FIG. 2 with the door in the closed position.

FIG. 5 is a view in section similar to that of FIG. 4 but with the door in the open position.

FIG. 6 is an enlarged view in section taken along the plane of the line 6—6 of FIG. 2 with the door in the closed position.

FIG. 7 is a side elevation view of the trigger sprayer similar to that of FIGS. 4 and 5 but with the door in a partially closed position, FIG. 8 is a perspective view of the discharge end of the trigger sprayer with parts broken away and with the door in the open position, and FIG. 9 is a partial somewhat schematic view of the nozzle and tube and illustrating planes that establish the minimum displacement of the door hinge above the tube.

DETAILED DESCRIPTION OF THE PREFERRED EMBODIMENT:

This trigger sprayer foamer 20, which is made entirely of plastic, has a housing 22 that is adapted to be threaded onto liquid receptacle 24. A nozzle assembly 26 on the forward end of the housing 22 regulates the character of fluids sprayed by the trigger sprayer 20. A trigger assembly 28 is manually operable in any of the known manners to pump liquid from the receptacle 24 through a passageway within the housing 22 to the nozzle assembly 26.

Within the housing 22 upstream of the nozzle assembly 26, there is a swirl chamber 30 and in the usual manner, a spinner (not shown) in the swirl chamber develops a swirling action to the liquid being pumped through the passageway in the housing 22 to the swirl chamber 30. The swirl chamber has a forward wall 32 through which there is a nozzle outlet orifice 34. The outlet orifice has a circular mouth 36 also forming a sealing seat.

To create a foaming action of the liquid (which would incorporate a foaming agent) a tube 37, preferably cylindrical, is integral with the nozzle assembly 26 and extends forwardly of the front wall 32 of the swirl chamber 30. The upstream end or entrance 38 of the tube 37 surrounds and is spaced radially outward from the nozzle discharge orifice 34. The downstream or discharge end 40 of the tube 37 is open. The tube 37 has a continuous side wall 42 having an inner surface 44 that typically is cylindrical. There are aeration openings 46 through the wall 42 located immediately downstream of the nozzle outlet orifice 34.

To provide a seal against leakage when the trigger sprayer is being shipped or is not in use, a plastic pin 48 is provided having a flat end 50 from which a partially spherical sealing tip 52 projects. The radius of the spherical sealing tip 52 is greater than the radius of the circular seat 36. When the spherical sealing projection 52 is pressed against the circular seat 36, part of the spherical projection 52 will enter the nozzle outlet orifice until a circular portion of it seals against the circular seat 36.

It has been determined it is important that the pin 48 be generally aligned with the axis of the cylindrical tube 36 when the pin is in its sealing position. Such an axial alignment assures that a good tight seal will be established between the spherical sealing projection 52 and the circular seat 36. It is also necessary that the pin 48 be positionable so that when the trigger sprayer is operated, the pin is substantially away from interference with obstruction of the path of flow of foamed liquid being dispensed. Finally, it is necessary that the pin be introduced into the cylindrical tube 36 and into engagement with the nozzle outlet orifice without traveling a path of interference with the wall of the tube 37. Because of the elongated configuration of the tube 37, and the consequent length of the pin required to reach the nozzle outlet orifice, it has been thought that movement of the pin would of necessity be generally axially aligned with the cylindrical tube, and any consideration of a pivotal support that would swing the pin through an arc into the cylindrical tube has been deemed not possible.

Pursuant to this invention, a geometry has been discovered that establishes parameters for the location of a hinge for a swinging door that supports the pin for swinging movement through an arc as the pin is introduced into and moves through the tube 37. With this swinging door, the pin is moved into a firm seating position in which it is generally aligned with the axis of the cylindrical tube when the door is in the closed position and, when the door is in the open position, both the door and the pin are swung to a position free from obstruction of the fluid being discharged from the trigger sprayer.

More specifically, the pin 48 projects from and is integrally molded with a door 54 that in turn is integrally molded with the nozzle assembly 26 through a living hinge 56. The door 54 is pivotally connected by the living hinge 56 to an upper wall 58 of the nozzle assembly 26. The hinge 56 may be formed of two components separated by a gap as illustrated or as a single continuous hinge, but in either case the location of the axis of the hinge 56 is an important feature of the invention as will be explained.

Preferably, the door 54 extends to a bottom wall 60 of the nozzle assembly 26 when the door is in the closed position that is illustrated in FIG. 4. In this closed position of the door 54, the pin 48 is generally positioned coaxial with the axis of the cylindrical tube 37 when its spherical sealing projection 52 rests against the circular seat 36. When the door 54 is in the open position, such as illustrated in FIG. 5, it and the pin 48 are positioned substantially beyond the path of flow of fluid from the open end 40 of the cylindrical tube 37. This open position of the door 54 may be upright as illustrated in FIG. 5 or may be a position angularly clockwise of the position illustrated in FIG. 5 so long as the door 54 and the pin 48 are substantially free from obstructing the fluid flow.

The swinging door 54 would not work if it were hinged at or near the cylindrical tube 37 because the pin 48 would be obstructed by the lowermost portion 62 of the tube end 40. According to this invention, it has been determined that the pivot axis of the hinge 56 should be no lower than the intersection of two planes. The first of those is the transverse vertical plane A (FIG. 9) defined by the open end 40 of the tube 37. That first plane defines a reference acute angle a with a reference plane B. The reference plane extends transversely from the inner wall 44 at the lowermost portion 62 of the tube end 40 through a point C that is spaced vertically below the center of the circular seat 36 by a distance equal to the radius of the pin 48. The second plane D extends transversely upwardly and angularly toward the first plane from the point C. The acute angle b made by the second plane D with the reference plane B is identical to the reference acute angle a. Consequently, the line of intersection E of the first and second planes A and D is above the tube 37 at a location affected by the length of the tube 37 relative to the nozzle orifice seat 36, the diameter of the inner tube surface 44, and the diameter of the pin 48. So long as the pivot axis of the hinge 56 is located at or above the intersection E of those two planes, A and D, the pin 48 will clear the lowermost extension 62 of the tube end 40 when the door 54 is swung through a clockwise arc from the open position illustrated in FIG. 5 toward the closed position illustrated in FIG. 4, with the intermediate clearing position being illustrated in FIG. 7.

The hinge 56 may be set slightly rearward of the open end 40 in which event the door 54 is provided with an annular recess 66 of a depth generally equal to that setback. When the door 54 is swung to the closed position the recess 66 receives the end portion of the tube 37 as illustrated in FIG. 4.

While the living hinge 56 returns the door 54 to the generally open position because of the internal memory of the living hinge, releasable locking means are provided for releasably locking the door 54 in its closed position. This releasable locking means may comprise a pair of keepers 68 molded on opposite sides of the tube 37 that cooperate with a pair of yieldable detents 70 that project from the door 54. The detents 70 yield and snap in place behind the keepers 68 to lock the door in the closed position. A lever 72 is provided at the free end of the door that can be grasped to disengage the keepers 70 and allow the door 54 to be swung open. The lever 72 may be provided with a finger engaging projection 74 to prevent the operator's finger from sliding off the lever 72 when the door is being swung toward a closed position from its open position. The lever 72 fits within a slot 76 with the door in the closed position.

The door 54 is provided with a thinner relief ring 78 around the area that contacts the free end 40 of the tube 37, allowing the door 54 to yield or flex. This flexing accommodates manufacturing tolerances that can result in variations in the length of the pin 48. The door 54 will press the shortest pin 48 against the sealing seat 36 and will flex if the pin is somewhat longer. Use One important advantage of this invention is that the trigger sprayer foamer 20 incorporates a foam-inducing tube 37 with an easily operable and less costly orifice sealing means. Since trigger sprayers are produced very inexpensively, small cost savings are of large significance. The sealing means of the present invention is of low cost because it is formed integral with the nozzle assembly 26 in a single molding procedure. The prior art separate removable nozzle sealing component that must be separately made is eliminated.

The sealing means of this invention is easy to use and the manner of use is obvious to the consumer. When the trigger sprayer is shipped or it is not in use, leakage of liquid is prevented by simply closing the door 54. This is accomplished by finger pressure applied to the lever 72 and against the projection 74. Because of the strategic location of the hinge 56 pursuant to this invention, the pin will clear the end 40 of the tube, as shown in FIG. 7, as the door is swung from its open position. As the door reaches the closed position illustrated in FIGS. 4 and 6, the latch means will releasably latch the door closed such that the detents 70 engage the keepers 68 as the pin automatically aligns with the axis of the tube 37 and the part-spherical tip 52 presses against the circular sealing seat 36.

When it is desired to operate the trigger sprayer foamer 20, the lever 72 is engaged by the operator's finger and pressure is applied to release the latching means and swing the door 54 to its open position. As the door is swung, the pin 54 automatically disengages from contact with the sealing seat 36. Once again, the pin 48 clears the tube 37 as illustrated in FIG. 7.

With the door in the open position, such as illustrated in FIGS. 3, 5 and 8, the trigger 28 can be operated in its usual manner to cause the trigger sprayer 20 to dispense a foamed liquid. Thereafter, the door 54 can be closed again and the nozzle orifice 34 will again be sealed fluid-tight.

While the present invention has been described by reference to specific embodiments, it should be understood that modifications and variations of the invention may be constructed without departing from the scope of the invention defined in the following claims.

What is claimed is:

1. A trigger sprayer having a housing, a fluid passage through the housing communicating with a source of liquid, a nozzle orifice through a wall of the housing communicating with the fluid passage, a tube supported by the wall and having one end communicating with the nozzle orifice, the tube projecting from the nozzle orifice and having an open free end spaced from the nozzle orifice, a door, a pin supported by and projecting perpendicularly from the door and having a free end adapted for closing the nozzle orifice, the pin being at least as long as the distance of the tube free end from the nozzle orifice measured along the longitudinals axis of the tube, hinge means for connecting the door to the housing for swinging movement of the door between a non-obstructing position at which the door and pin are substantially out of the path of liquid flowing from the tube and a sealing position at which the free end of the pin engages the nozzle orifice, the axis of the hinge means being generally in the plane of the free end of the tube and being spaced from the tube a sufficient distance to enable the pin to clear the free end of the tube when the door is swung toward the tube and to locate the free end of the pin in fluid sealing position against the nozzle orifice when the door is adjacent the free end of the tube.

2. The trigger sprayer of claim 1 wherein: the distance between the hinge means and a point spaced below the center-line of the nozzle orifice by an amount equal to the radius of the pin is substantially equal to the distance between the hinge means and the portion of the inner wall of the tube furthest from the hinge means.

3. The trigger sprayer of claim 1 wherein, a transverse plane between a point spaced below the center-line of the nozzle orifice by an amount equal to the radius of the pin and the portion of the inner wall of the tube furthest from the hinge means defines with the plane of the tube end an angle substantially equal to the angle defined by said transverse plane and a line between said point and the hinge means.

4. The trigger sprayer of claim 1 including:

the length of the pin is slightly greater than the distance from the nozzle orifice to the free end of the tube, and means for releasably locking the door in a position that presses the free end of the pin against the nozzle.

5. The trigger sprayer of claim 4 wherein:

the locking means includes keeper means and resilient latch means one on the outside wall of the tube and the other on the door.

6. The trigger sprayer of claim 4 wherein:

the door incorporates relief areas to allow flexing for accommodation of manufacturing tolerances affecting the length of the pin when the door is in the sealing position.

7. The trigger sprayer of claim 1 wherein:

the free end of the pin is spherical to fit past the free end of the tube when the door is swung and for partially entering the nozzle orifice in the sealing position.

8. The trigger sprayer of claim 7 wherein:

the diameter of the spherical end is greater than the diameter of the orifice.

9. The trigger sprayer of claim 1 wherein:

the free end of the pin has a convex projecting surface whereby the convex projecting surface clears the inner door of the tube during swinging movement of the wall and the convex projecting surface can enter the nozzle orifice.

10. The trigger sprayer of claim 1 wherein:

there are aspirating ports through the tube.

11. A sprayer including a nozzle assembly for discharging and aerating a liquid and for selectively sealing against leakage of the liquid comprising:

a housing having passage means for conveying pressurized liquid from a liquid source to the nozzle assembly, a nozzle assembly outlet orifice through a wall of the nozzle assembly and communicating with the passage means, means upstream of the nozzle outlet orifice to produce swirling of the liquid that enters the nozzle outlet orifice, an elongated tube having a proximate end surrounding the nozzle outlet orifice, an open distal end for discharging fluid, and a tubular wall connected between the ends, a door, hinge means for pivotably connecting the door to the nozzle assembly for swinging movement between an open position substantially out of the path of the flow of fluid discharged from the tube and a closed position adjacent the open end of the tube, a pin projecting from the door, the length of the pin being substantially equal to the length of the tube, the pin being positioned substantially coaxial with the tube when the door is in its closed position and having an end for sealing the nozzle orifice when the pin is thus positioned, the hinge means being spaced from the tube a distance sufficient to allow the pin to clear the tube when the door is swung between its open and closed positions.

12. The sprayer of claim 11 including:

means for releasably latching the door in the closed position.

13. The sprayer of claim 11 including:

a partial spherical tip on the pin for engagement with the nozzle orifice when the door is in the closed position.

14. A trigger sprayer comprising:

a nozzle assembly, a nozzle outlet orifice, for discharging fluid from the nozzle assembly, a foam-inducing tube downstream of the orifice, an elongated pin having a convex tip for engaging and sealing the orifice, a door for supporting the pin, and a hinge connecting the door to the nozzle assembly and located to prevent interference between the pin and the tube when the door is swung about the hinge between an open position and a closed position, the pin being oriented on the door to be positioned generally coaxial with the tube with the convex tip in sealing engagement with the orifice when the door is in the closed position and to be fully withdrawn from the tube when the door is in the open position.

* * * * *